United States Patent [19]

Haener

[11] Patent Number: 4,640,071

[45] Date of Patent: Feb. 3, 1987

[54] INTERLOCKING BUILDING BLOCK

[76] Inventor: Juan Haener, 8215 Harton Pl., San Diego, Calif. 92123

[21] Appl. No.: 754,136

[22] Filed: Jul. 12, 1985

[51] Int. Cl.[4] ..... E04C 1/08; E04C 1/10; E04C 1/30

[52] U.S. Cl. ..... 52/286; 52/589; 52/442; 52/505; 52/100

[58] Field of Search ..... 52/284, 286, 98, 99, 52/100, 426, 439, 505, 561, 565, 593, 589, 442, 503

[56] References Cited

U.S. PATENT DOCUMENTS

| | | | |
|---|---|---|---|
| 3,888,060 | 6/1975 | Haener | 52/284 |

FOREIGN PATENT DOCUMENTS

| | | | |
|---|---|---|---|
| 215707 | 5/1955 | Australia | 52/442 |
| 892329 | 2/1972 | Canada | 52/426 |
| 353101 | 7/1931 | United Kingdom | 52/505 |
| 953739 | 3/1964 | United Kingdom | 52/439 |
| 1385045 | 2/1975 | United Kingdom | 52/100 |

*Primary Examiner*—James L. Ridgill, Jr.
*Attorney, Agent, or Firm*—Frank D. Gilliam

[57] ABSTRACT

A block of concrete or the like for use in constructing a mortarless wall is provided which includes a spaced parallel pair of upright sidewalls having flat bottoms and tops and bearing integral block interlocking connectors on their opposite ends. The sidewalls are integrally connected to one or more transverse webs extending from the bottom of the sidewalls to above the tops thereof. Parallel slits may divide the upper end of the web into knock-off portions for installation of reinforcing bars. Each web has a central concavity in the upper end of at least one opposite side thereof, which concavity slope down into a complimentary central bottom convexity. The web tapers in thickness from bottom to top. The concavity and convexity can be triangular, dish-shaped, rectangular, etc. The webs define cells in the block when a number of the blocks are vertically stacked in staggered array to form a wall. The webs make point or line contact with each other to interlock and prevent horizontal displacement, while presenting staggered cells and maximum surface area for adhesion to reinforcing concrete poured into the cells. The block is inexpensive, durable, strong and easy to use.

30 Claims, 17 Drawing Figures

INTERLOCKING BUILDING BLOCK

BACKGROUND OF THE INVENTION

The present invention generally relates to construction materials and, more particularly, to a mortarless wall block of an improved type.

Conventional concrete block walls are laid up by a time-consuming difficult procedure which involves troweling a layer of concrete mortar onto a level concrete or stone base or the like, or the top of a course of previously laid blocks and then setting blocks one at a time in the mortar layer, in each instance also applying mortar to the end walls of each block to join the blocks together. This procedure is continued until the required number of courses are laid. Great care must be taken to keep each course perfectly horizontal and straight. Few people have the skill to carry out such a procedure in a competent manner. Therefore, the cost of such construction is always high.

Various types of interlocking blocks have been devised in the past to facilitate block laying. However, most such blocks are very expensive to produce since the interlocking portions, usually grooves and protrusions, normally are sawed into or otherwise fashioned in the blocks after they are initially formed by molding. Moreover, those interlocking blocks in which the interlocking components are initially molded usually are very difficult to mold to acceptably close tolerances.

An improved interlocking mortarless building block overcoming these deficiencies is set forth in U.S. Pat. No. 3,888,060 issued June 10, 1975, to the inventor of the present invention. That block has been used successfully for a number of years. The block includes flat faced, spaced vertical sidewalls joined by flat faced vertical transverse webs to form a series of cells. The blocks are disposed one upon another in ascending courses in staggered relationship during the construction of a wall. The superposed block cells fully communicate with each other.

It has been found that under certain circumstances, additional structural strength is needed and that when wet concrete is poured into the cells and allowed to dry the poured concrete does not always fully adhere to the flat cell walls with maximum strength. Strength is in part due to the surface area of contact between the block walls and the set poured cement.

Accordingly, it would be desirable to be able to provide an improved mortarless building block featuring improved adaptability, strength and economy. The design of the block should be such that it can be readily moulded and released from the forming mold with full detail preserved, obviating any subsequent reshaping, finishing, etc. Moreover, the block should be easily strengthened with reinforcing bars, if needed, and be capable of being fabricated in a full array of sizes and shapes.

SUMMARY OF THE INVENTION

The improved building block of the present invention satisfies all the foregoing needs. The block is substantially as set forth in the Abstract above. Thus, the block includes a pair of parallel sidewalls interconnected by preferably a plurality of spaced parallel transverse webs extending from the bottom of the sidewalls to above the top thereof and dividing the block into cells. The webs and sidewalls are tapered from bottom to top in that they have at least one non-vertical upraised side. Specifically, at least one of the two raised sides of the web includes a central concavity at the upper end thereof tapering down linearly or not linearly to a complementary convexity at the central lower end thereof. In case of linear tapering the thickness of the web at the midpoint of that side is about equal to one-half of the combined thicknesses of the web at any two points along that center and equidistant from that midpoint, i.e., above and below that midpoint. Therefore, the mass of the web is balanced, the block has increased stability, the web presents a larger surface area for connection to cement poured into a cell, and the block more easily releases from a single forming mold during its fabrication. The convexities and concavities can be triangular, rectangular, dish-shaped or the like.

The webs preferably each have a plurality of spaced slits parallel to the sidewalls and extending down into the web from the top of the sidewalls a distance equal or greater than the thickness of a reinforcing bar which could be placed longitudinally in the block. If it is desired to use such bars, the appropriate knock-off portions defined in the webs by the slits are broken away and the reinforcing bars are laid in their place. Certain slits can also separate the upper ends of the web from the sidewalls and are useful for providing knock-off portions for insertion of two parallel reinforcing bars to compensate for bending stresses in certain structural locations.

The blocks can be designed to interlock at their opposite ends by means of tongues and grooves or the like, to form courses. No mortar is needed. The courses may be disposed upon each other without the use of mortar, with the blocks in one course staggered with respect to those of the adjacent courses. The upper portions of the webs of blocks in a given course are positioned to point contact the underside of the webs of the course next above to interlock the blocks and courses together. The cells thereof are in staggered array and exhibit angled walls and a greater surface area for joinder to concrete when the latter is poured into vertically connected cells to strengthen the thus formed wall.

Thus, the new improved building blocks are simple, rapid and inexpensive to fabricate and to use and provide a superior wall when laid up in the described manner. Further features of the present invention are set forth in the following detailed description and accompanying drawings.

DETAILED DESCRIPTION OF THE DRAWINGS

Figure 1:
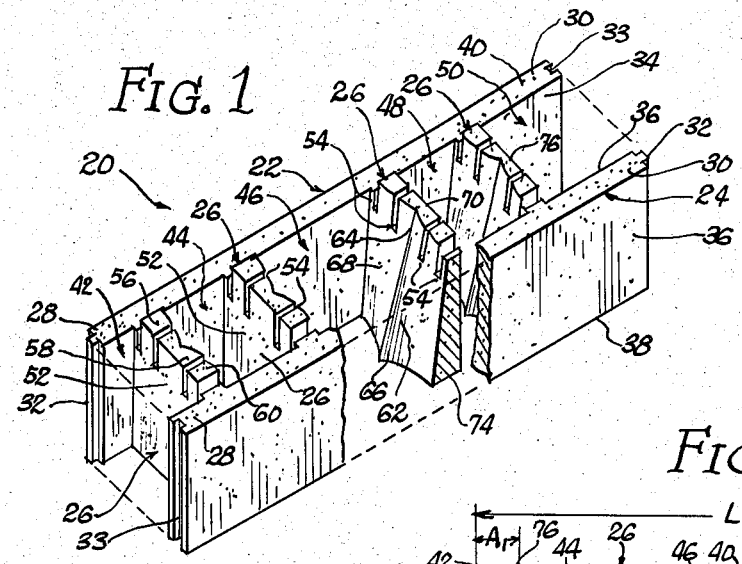
FIG. 1 is a schematic perspective view, partly broken away, of a first preferred embodiment of an open ended type of the improved building block of the present invention.
Figure 2:
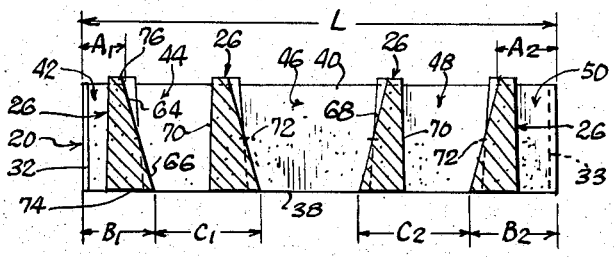
FIG. 2 is a schematic longitudinal center cross-section of the block of FIG. 1.
Figure 3:
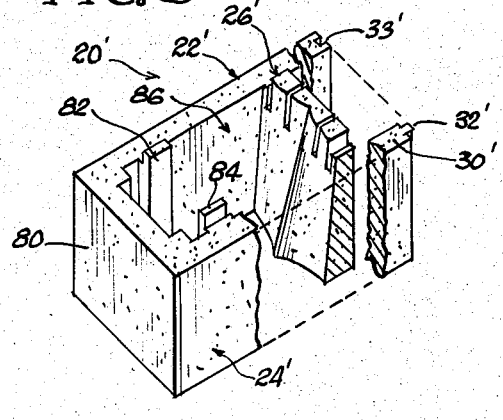
FIG. 3 is a schematic perspective view, partly broken away, of a first preferred embodiment of an end or corner type of the improved building block of the present invention.
Figure 4:
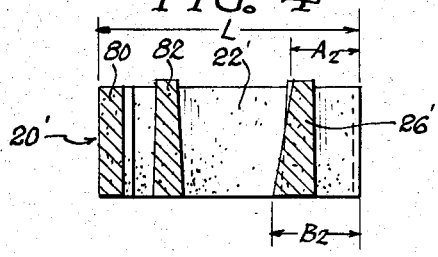
FIG. 4 is a schematic longitudinal center cross-section of the block of FIG. 3.
Figure 5:
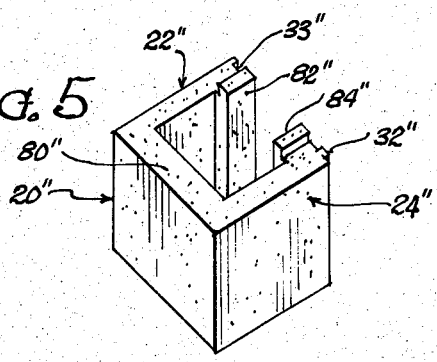
FIG. 5 is a schematic perspective view of a first preferred embodiment of a short end type of the improved building block of the present invention.
Figure 6:
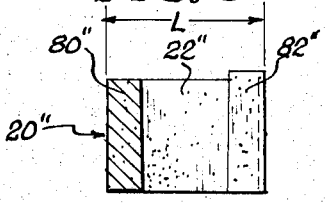
FIG. 6 is a schematic longitudinal center cross-section of the block of FIG. 5.
Figure 7:
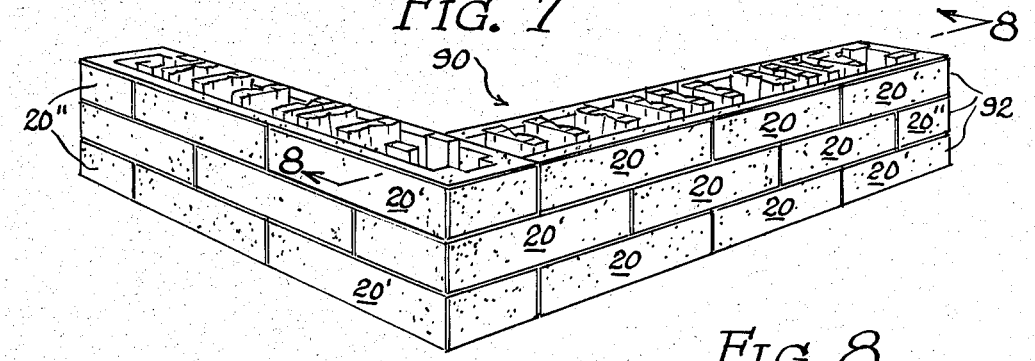
FIG. 7 is a schematic perspective view of an L-shaped wall during construction thereof, said wall employing the blocks of FIGS. 1, 3 and 5.
Figure 8:
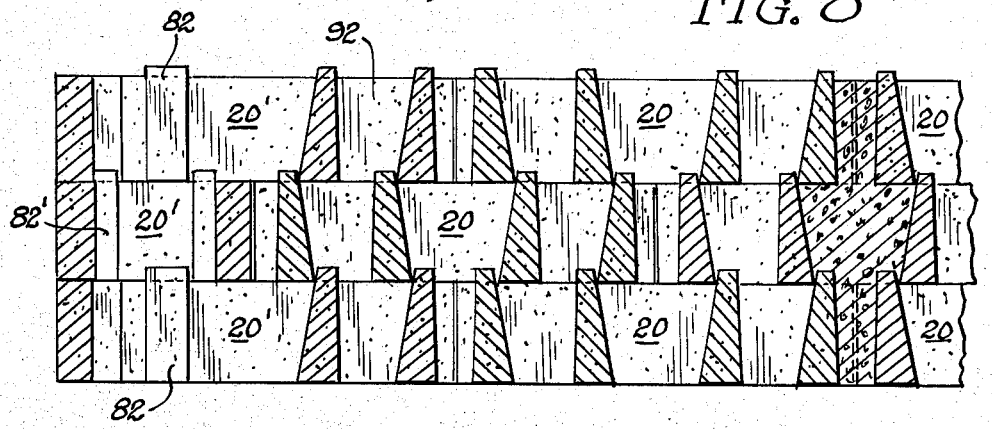
FIG. 8 is a schematic fragmentary longitudinal center cross-section of the wall of FIG. 7.

Now referring, more particularly, to FIGS. 1–8, a first preferred embodiment of the improved building block of the present invention is schematically depicted therein. Thus, FIGS. 1 and 2 depict the form of the block which is used between the ends and corners of a wall construction. FIGS. 3 and 4 depict a long corner form of the same type block, and FIGS. 5 and 6 depict a short end form of the block. FIGS. 7 and 8 depict a wall constructed of the blocks of FIGS. 1–6.

In FIGS. 1 and 2, block 20 is shown. Block 20 can be of any suitable construction material, such as poured set cement, concrete, or can be a so-called cinder block or a block of ceramic clay or other suitable construction material. Block 20 comprises a spaced, parallel pair of vertical sidewalls 22 and 24 interconnected by integral vertical webs 26, perpendicular to sidewalls 22 and 24 and disposed in a predetermined arrangement in block 20. Preferably, each of sidewalls 22 and 24 have flat parallel or tapered opposite faces 34 and 36, flat bottoms 38 and flat tops 40. Opposite ends 28 and 30 of walls 22 and 24 are provided with interlocking means in the form of tongues 32 and grooves 33 for joining blocks 20 lengthwise in a course during laying up of a wall. Webs 26 and sidewalls 22 and 24 divide block 20 into cells 42, 44, 46, 48 and 50 spaced along the length of block 20 and open at the bottom and top thereof and of predetermined size.

Webs 26 extend from about bottoms 38 to above tops 40, as shown in FIGS. 1 and 2. Preferably, webs 26 extend above tops 40 about 10% of the height of block 20. For example, sidewalls 22 and 24 may be about 8 inches high with webs 26 extending about ⅜ inch thereabove. Other dimensions are also suitable. The upper portion 52 of each of webs 26 is preferably divided by four spaced, parallel vertical slits 54 extending down therethrough and totally across the thickness of portion 52 parallel to sidewalls 22 and 24 so as to form three separate top break-off sections 56, 58 and 60 in each portion 52. Central section 58 usually is wider than side sections 56 and 60. Slits 54 exend down in portion 52 a sufficient distance below tops 40 so that each of sections 56, 58 and 60 is deep enough to accommodate, when broken off, the full thickness of a reinforcing bar (not shown) which is adapted to extend longitudinally in block 20 below tops 40. It will be understood that the desired number of the same type of break-off sections can be removed from the particular webs 26 involved in block 20 so as to accommodate the full length of such a bar.

Normally, section 58 is not used as a break-off section. Instead, section 58 and portion 62 lying below section 58 and extending to the bottom of each web 26 is specially configured, so as to include a generally triangular concavity 64 in section 58 and a complementary generally triangular convexity 66 in portion 62, which grades thereinto. Each triangular configuration has curved sides. Concavity 64 and convexity 66 appear in only one side 68 of each web 26, the opposite side 70 thereof being flat and vertical (not shown) or slightly sloped toward portions 66 and 68 from bottom surface 74 toward upper surface 76 (as shown in the figures) to form a double taper to web 26 between the bottom surface 74 and upper surface 76 which provides improved disingagement of the block from its forming mold. This is more easily seen in FIG. 2. Thus, at the center midpoint 72 along the length of side 68 of each web 26, neither concavity 64 nor convexity 66 is present. The thickness of each web 26 at point 72 (the midpoint of the center longitudinal cross-section of web 26) is equal to one-half the sum of the thicknesses of the web at any two points equidistant from point 72; that is, above and below point 72 and along the center longitudinal cross-section. In effect, each web 26 uniformly or non-uniformly slopes from concavity 64 to convexity 66 so that the bottom 74 of each web 26 is thicker than the top 76 thereof at the center of side 68. This improves the stability of block 20 and facilitates its release from an open bottomed mold. This also increases the total surface area of web 26 for improving its adhesion to reinforcing cement which may be poured into cells 42, 44, 46, 48 and 50. It will be noted that different ones of webs 26 have their web sides 68 differently oriented, as shown in FIG. 1, i.e., facing away or toward each other, as more particularly referred to below. Block 20 is simple, rapid and inexpensive to mold in a single operation from a single mold and is easy to use in constructing a wall.

FIGS. 3 and 4 schematically depict a corner form of the block of the same embodiment as that of FIGS. 1 and 2. Thus, block 20′ is shown which is similar to block 20. Components thereof similar to those of block 20 bear the same numerals, but are succeeded by the prime sign "′". Block 20′ includes sidewalls 22′ and 24′ and webs 26′, one of which is shown in FIG. 3. Block 20′ also includes an end wall 80 interconnecting sidewall 22′ and 24′ and a pair of spaced vertical supports 82 and 84 integrally connected to sidewalls 22′ and 24′, respectively, and disposed in space 86 between wall 80 and web 26′. One tongue 32′ and one groove 33′ are present in end 30' of each of sidewalls 22' and 24'. Corner block 20' is used in a wall assembly, such as is shown in FIGS. 7 and 8.

FIGS. 5 and 6 schematically depict a short end form of the block of the same embodiment as that of FIGS. 1 and 2. Thus, Block 20" is shown which is similar to block 20 and block 20'. Components thereof similar to those of block 20 and/or block 20' bear the same numerals but are succeeded by the double prime sign "". Block 20" includes short sidewalls 22" and 24", end wall 80" and vertical supports 82" and 84", as well as tongue 32" and groove 33", but no transverse web. Block 20" is used in a wall assembly, such as is shown in FIGS. 7.

FIG. 7 schematically depicts an L-shaped wall 90 laid up very easily, rapidly and accurately without professional labor and without mortaring by using blocks 20, 20' and 20" to form stacked horizontal courses 92. It will be noted that blocks 20, 20' and 20" are interconnected one by one lengthwise by their respective tongues and grooves so that no mortar whatsoever is needed to lay up courses 92. Courses 92 are laid up with blocks 20, 20' and 20" of one course offset lengthwise with blocks 20, 20' and 20" of the two adjoining courses (FIG. 7). Moreover, courses 92 are easily kept straight and level because tops 40 and bottoms 38 are flat and horizontal, the bottoms 38 of one course 92 resting directly on the tops 40 of the next lower course 92.

In addition, lateral displacement of the respective blocks 20, 20' and 20" is prevented due to the fact that upper portions 52 of the webs 26 and 26' of blocks 20 and 20' in a given course 92, as well as supports 82 and 84, 82" and 84" project upwardly into the respective cells of the blocks in the next above course 92. Those projecting webs 26 and 26' abut by point contact the lower portions of webs 26 and 26'. This is shown in those blocks in the upper course providing positive alignment of the courses 92 containing blocks 20, 20' and 20". Moreover, the cells in blocks 20, 20' and 20" have extended surface area due to the angling of portions of webs 26 and 26' so that when wet aggregate as shown at the right hand side of FIG. 8 is poured thereinto to bond wall 90 together, that aggregate more readily and strongly bonds thereto, and wall 90 has a resultingly increased strength.

FIGS. 9–14 depicts further embodiments of the improved block of the present invention which materially differ from blocks 20, 20' and 20" only in regard to the number of webs employed and their particular spacing of such webs. The overall shapes of such webs are generally the same as webs 26 and 26'. The relative dimensions of the various webs depicted in FIGS. 9–14 can be easily compared with webs 26 and 26' by reference to proportion reference indications of component portions marked L, A1, A2, B1, B2, and C in FIGS. 9–14 and L, A1, A2, B1, B2, C1 and C2 in FIGS. 2, 4 and 6. The blocks of the present invention follow the same proportional relationships as are embodied in the formulas set forth in U.S. Pat. No. 3,888,060. Thus, $L$ (length)$=B1+B2+A1+A2+C1+C2$ as described in the patent.

Figure 9:
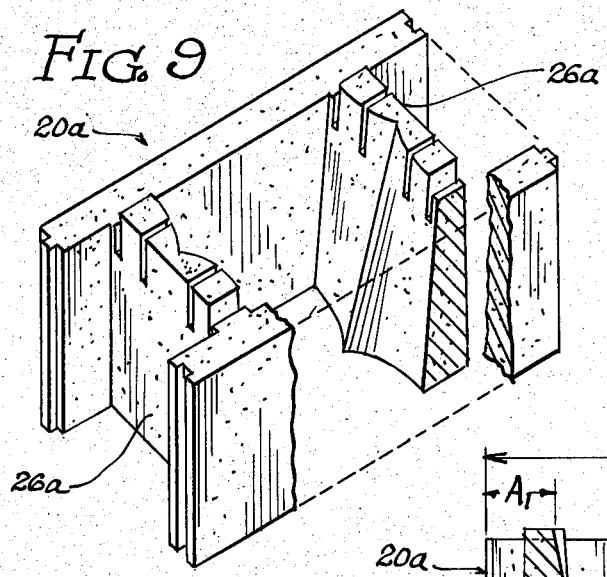
FIG. 9 is a schematic perspective view, partly broken away, of a second preferred embodiment of an open ended type of the improved building block of the present invention.
Figure 10:
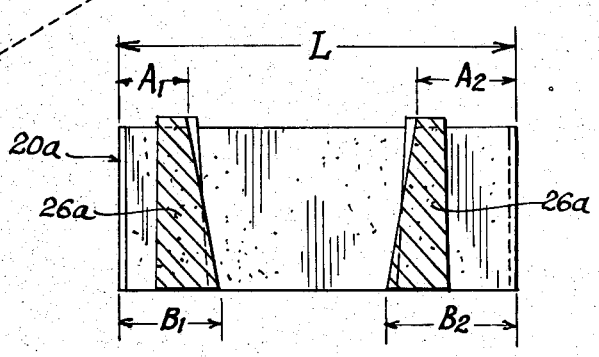
FIG. 10 is a schematic longitudinal center cross-section of the block of FIG. 9.
Figure 11:
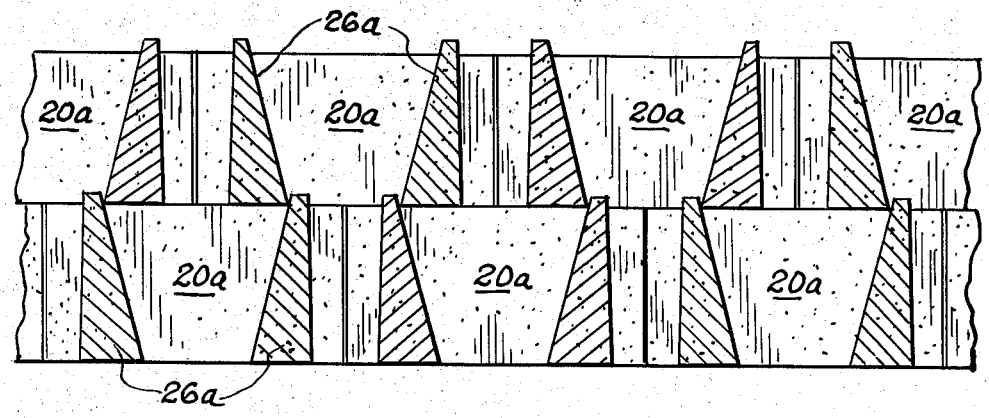
FIG. 11 is a schematic fragmentary longitudinal center cross-section of a wall utilizing a plurality of the blocks of FIG. 9.

It will thus be seen that in FIGS. 9–11 and block 20*a* is substantially identical to block 20, except it contains only two webs 26*a*, rather than four webs, as in block 20.

Figure 12:
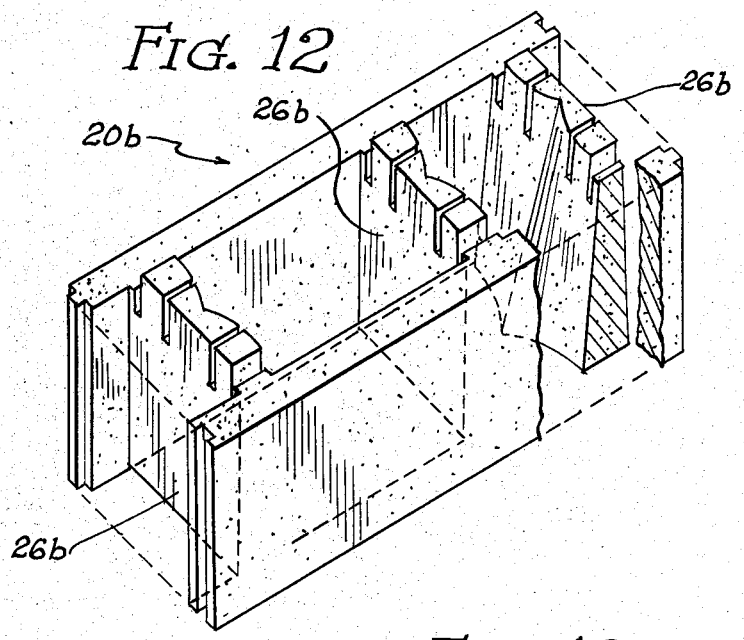
FIG. 12 is a schematic perspective view partly broken away, of a third preferred embodiment of the open ended type of improved building block of the present invention.
Figure 13:
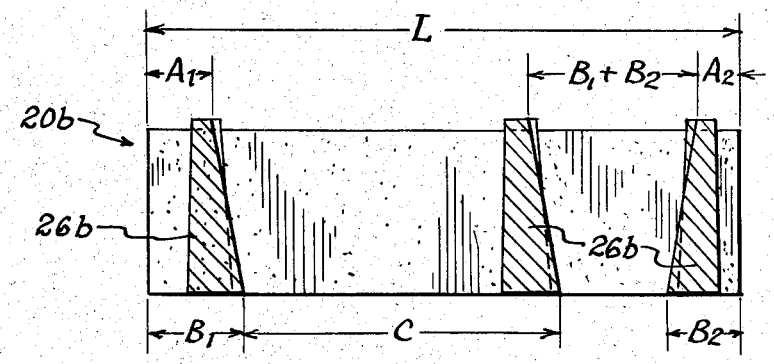
FIG. 13 is a schematic longitudinal center cross-section of the block of FIG. 12.
Figure 14:
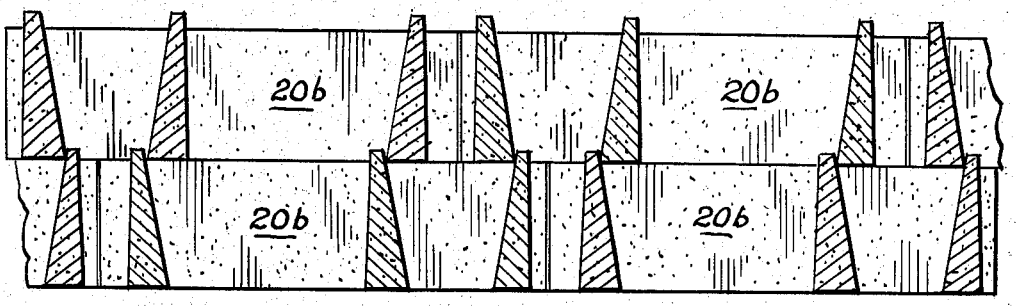
FIG. 14 is a schematic fragmentary longitudinal center cross-section of a wall constructed of a plurality of the blocks of FIG. 12.

Block 20*b* shown in FIGS. 12, 13 and 14 has three webs 26*b*, each of which is similar to webs 26 and 26'. FIG. 14 schematically depicts a wall laid up using blocks 20*b*.

Figure 15:
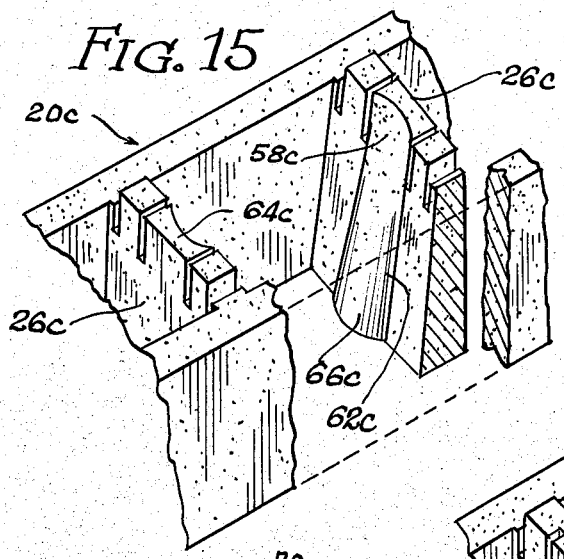
FIG. 15 is a schematic fragmentary perspective view of a fourth preferred embodiment of the open ended type of improved building block of the present invention.
Figure 16:
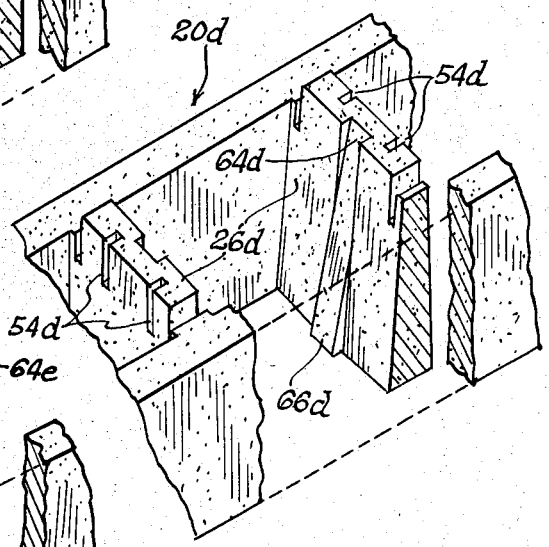
FIG. 16 is a schematic fragmentary perspective view of a fifth preferred embodiment of the open ended type of improved building block of the present invention; and, FIG. 17 is a schematic fragmentary perspective view of a sixth preferred embodiment of the open ended type of improved building block of the present invention.
Figure 17:
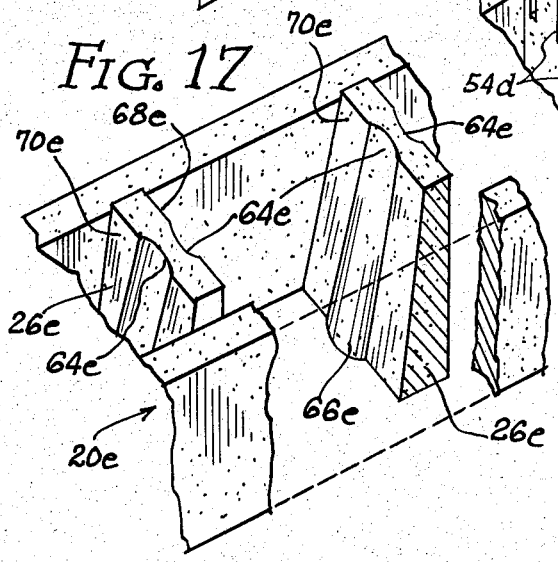

FIGS. 15, 16 and 17 depict blocks of the present invention which differ from block 20 only in the particular shape of center portion of the webs thereof. Thus, in FIG. 15, block 20*c* is shown which is identical to block 20 except that each web 26*c* has a central dish-shaped top concavity 64*c* sloping downwardly into a bottom dish-shaped convexity 66*c*. Concavity 64*c* and convexity 66*c* are located in, respectively, sections 58*c* and 62*c*. The thickness of web 26*c* along its center longitudinal cross-section follows the same rules generally as specified for web 26. Web 26*c* has increased surface area, as does web 26.

FIG. 16 depicts block 20*d* identical to block 20' in all respects except that each web 26*d* thereof has a rectangular concavity 64*d* sloping down and blending into a rectangular convexity 66*d*, and except that the two most central of slits 54*d* extend only part of the way through the thickness of web 26*d*, so that web 26*d* is strengthened. Web 26*d* also has increased surface area for improved adhesion to poured aggregate.

FIG. 17 depicts block 20*e* which is identical to block 20 in all respects except that each web 26*e* thereof has a dish-shaped concavity 64*e* and a dish-shaped convexity 66*e* in each of its two sides 68*e* and 70*e*, and except that web 26*e* contains no slits 54 at all and thus is relatively stronger. The thickness of web 26*e* along its center longitudinal cross-section follows the rules previously described for web 26. Accordingly, web 26*e* has substantially increased surface area.

Various other modifications, changes, alterations and additions can be made in the improved building block of the present invention, its components and their parameters. All such modifications, changes, alterations and additions as are within the scope of the appended claims form part of the present invention.

What is claimed is:

1. An improved interlocking block for a mortarless wall assembly in which a plurality of such blocks are interlocked together to create a substantially continuous planar wall surface having a plurality of stacked linear courses of such blocks bonded together internally by cementitious bonding material, the blocks in each course being mechanically interlocked in end to end relation, with adjacent blocks on the same course, the blocks in a given one of said courses being mechanically interlocked in a staggered relation to the blocks in the abutting courses in said stack, said blocks comprising:

(a) a pair of spaced, parallel, upright sidewalls having flat top and bottom surfaces, said sidewalls having block-interlocking means on opposed ends thereof; and (b) at least one transverse upright support web spanning said sidewalls and integral and defining a cavity therewith for receiving said cementitious material therein, said web having a concavity disposed at the upper end of one side thereof and a complimentary convexity disposed at the lower end of said one side, said convexity uniformly sloping upwardly into said concavity, the opposite side of said web sloping upwardly toward said one side, said web is shaped for facilitating release of said block from its forming mold for reducing mold wear thereby and to provide an increased surface area for improving adhesion of said cementitious bonding material thereto when poured into the cavities of said blocks when said blocks are stacked to form said continuous planar wall surface, the upper surface of said web is divided by parallel slits into three separate knockoff portions any one of which can be removed to permit the addition of reinforcing bars extending longitudinally through the block of each course while maintaining the block of abutting courses in their mechanically interlocked relationship.

2. The improved block of claim 1 wherein said web uniformly tapers down in thickness from the bottom to the top thereof to facilitate release of said block from a forming mold during fabrication of said block.

3. The improved block of claim 1 wherein said concavity is generally triangular.

4. The improved block of claim 1 wherein said concavity is generally rectangular.

5. The improved block of claim 1 wherein said web concavity and convexity are disposed along the center of said one side and wherein the thickness of said web at the midpoint of the length of said side center is about equal to one-half the combined thickness of said web at any two equidistant points along said side center above and below said midpoint.

6. The improved block of claim 5 wherein each of said two opposite sides of said web has a concavity and complementary convexity.

7. The improved block of claim 5 wherein said concavity is generally dish-shaped.

8. The improved block of claim 5 wherein said block comprises molded set concrete.

9. The improved block of claim 1 wherein said web extends from the bottom of said sidewalls to above the top of said sidewalls, and that portion of said web above said sidewalls comprising locking means, and wherein a plurality of said webs are spaced parallel to each other in said block and about perpendicular to said sidewalls.

10. The improved block of claim 9, wherein said webs are positioned such that when a plurality of said blocks are disposed in staggered stacked relation to form a wall assembly, said webs intersect each other to make point contact with each other for interlocking said blocks against horizontal displacement.

11. The improved block of claim 10 wherein said webs divide said block into a plurality of cells and wherein when a plurality of said blocks are disposed in staggered stacked relation to form a wall assembly, adjoining stacked ones of said cells are in staggered array with each other to provide increased surface area for the adhesion of cementitious material to said webs when poured into said cells.

12. The improved block of claim 1 wherein the upper portion of said web is divided by parallel slits into a plurality of knock-off portions which can be removed to permit the addition of longitudinally extending reinforcing bars to said block, said slits extending down into said web a predetermined distance at least about equal to the thickness of said bars.

13. The improved block of claim 12 wherein said slits extend only partially through the thickness of said web upper end in a direction parallel to said sidewalls, whereby the strength of said web is improved.

14. The improved block of claim 12 wherein two of said slits separate said upper end of said web from said sidewalls and are adjacent said sidewalls.

15. The improved block of claim 14 wherein there are four of said slits in said web parallel to said sidewalls and wherein there are three of said knock-off portions.

16. An interlocking block for use in a wall construction assembly, said block comprising:

(a) a pair of spaced, vertically extending sidewalls,
(b) a first web extending between said sidewalls,
(c) a second web extending between said sidewalls,
(d) said first and second webs having a concavity disposed in the top portion, said top portion extending above the top of said sidewalls,
(e) said first and second webs having a concavity disposed in the bottom portion, said bottom portion which does not extend below the bottom of said sidewalls,
(f) said top portion having an average thickness which is smaller than the average thickness of said bottom portion,
(g) wherein the thickness of said web is variable along the length thereof.

17. The block of claim 16 wherein the concavity in the top portions of said first and second webs face one another.

18. The block of claim 17 wherein the convexities in the bottom portion of said first and second webs faces one another.

19. The block of claim 18 wherein said concavities and convexities in said first and second webs are disposed opposite and facing one another.

20. The block of claim 19 wherein said concavities and convexities in each web are complimentary to one another.

21. The block of claim 20 wherein said concavity is generally rectangular.

22. The block of claim 20 wherein said concavity is generally triangular.

23. The block of claim 20 wherein said concavity is generally dish-shaped.

24. The block of claim 20 wherein the right side of each web is a mirror image of the left side of each web.

25. The block of claim 20 wherein the thickness of the top and bottom portions of each web are continuously variable along their lengths. the front face of said web defines a first straight line.

26. The block of claim 20 wherein the intersection between said given plane and the rear face of said web defines a second straight line.

27. The block of claim 20 wherein the upper half of each web has a concavity therein and the lower half of each web has a complimentary convexity therein.

28. The block of claim 20 wherein said upper portion has a plurality of vertically extending slots therein defining knock-out portions.

29. The block of claim 20 wherein the intersection between a given plane extending perpendicular to a web and the front face of said web defines a first straight line.

30. The block of claim 29 wherein said straight lines are not parallel to one another.

* * * * *